US007717101B2

(12) United States Patent
Beetz et al.

(10) Patent No.: US 7,717,101 B2
(45) Date of Patent: May 18, 2010

(54) CENTRIFUGAL OIL MIST SEPARATION DEVICE INTEGRATED IN AN AXIAL HOLLOW SHAFT OF AN INTERNAL COMBUSTION ENGINE

(75) Inventors: Klaus Beetz, Karlsruhe (DE); Andreas Enderich, Esslingen (DE); Hartmut Sauter, Renningen (DE); Torsten Schellhase, Vaihingen/Enz (DE); Jürgen Stehlig, Neckartenzlingen (DE)

(73) Assignee: MAHLE International GmbH, Stuttgart (DE)

( * ) Notice: Subject to any disclaimer, the term of this patent is extended or adjusted under 35 U.S.C. 154(b) by 425 days.

(21) Appl. No.: 11/660,831

(22) PCT Filed: May 6, 2006

(86) PCT No.: PCT/DE2006/000781

§ 371 (c)(1),
(2), (4) Date: Feb. 22, 2007

(87) PCT Pub. No.: WO2006/119737

PCT Pub. Date: Nov. 16, 2006

(65) Prior Publication Data

US 2007/0294986 A1 Dec. 27, 2007

(30) Foreign Application Priority Data

May 10, 2005 (DE) ..... 10 2005 022 254
Sep. 8, 2005 (DE) ..... 10 2005 042 725

(51) Int. Cl.
*F01M 1/00* (2006.01)

(52) U.S. Cl. ..... 123/572; 123/41.86

(58) Field of Classification Search ..... 123/572–574, 123/41.86
See application file for complete search history.

(56) References Cited

U.S. PATENT DOCUMENTS 1,979,025 A 10/1934 Carvelli (Continued)

FOREIGN PATENT DOCUMENTS

DE 1 955 966 C 6/1970

(Continued)

*Primary Examiner*—M. McMahon
(74) *Attorney, Agent, or Firm*—Collard & Roe, P.C.

(57) ABSTRACT

A centrifugal oil mist separator device integrated into an axially hollow camshaft of an internal combustion engine should permit a good separation effect.

Figure 1:
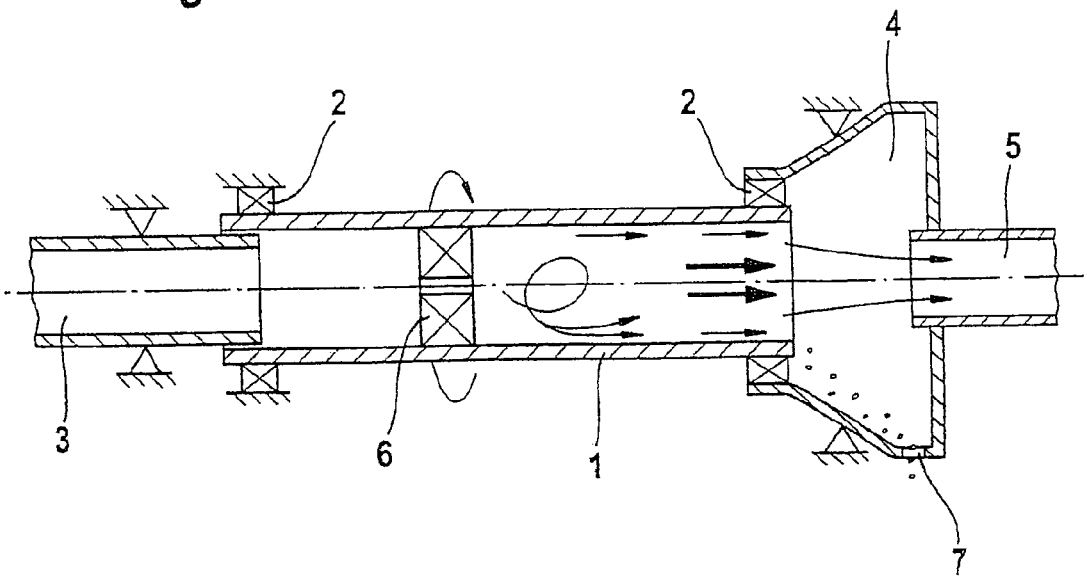

To this end, a device is provided whereby
- the camshaft (101) is provided
  - on a first end with radial oil mist inlet openings (106) for oil mist to be introduced into the axially hollow space (102) in the camshaft (101) and
  - on the second end, for discharge with a radial oil discharge channel (112) for oil separated as liquid phase on the one hand and with an axial gas discharge channel (113) on the other hand for oil mist stream remaining after the liquid component has been separated,
- a centrifugal oil mist pre-separator is provided upstream from the radial oil mist inlet openings (106) as a pre-separator (107) fixedly connected to the camshaft (101), and
- within the axially hollow space (102) in the camshaft (101) a spiral flow generating device (108) is provided as the final separator.

16 Claims, 2 Drawing Sheets

U.S. PATENT DOCUMENTS

| | | | | |
|---|---|---|---|---|
| 2,818,047 | A | 12/1957 | Powell | |
| 3,561,195 | A | 2/1971 | Bouru | |
| 4,189,310 | A | 2/1980 | Hotta | |
| 4,329,968 | A | 5/1982 | Ishikawa et al. | |
| 4,651,704 | A | 3/1987 | Sekiguchi | |
| 5,954,035 | A * | 9/1999 | Hofer et al. | 123/573 |
| 6,109,250 | A * | 8/2000 | Haberlein et al. | 123/572 |
| 6,502,565 | B2 * | 1/2003 | Schmid et al. | 123/572 |
| 7,309,308 | B2 * | 12/2007 | Berger et al. | 494/81 |

FOREIGN PATENT DOCUMENTS

| | | | |
|---|---|---|---|
| DE | 35 41 204 | A1 | 5/1987 |
| DE | 196 08 503 | C2 | 10/1999 |
| DE | 197 06 383 | C2 | 5/2000 |
| DE | 199 14 166 | A1 | 10/2000 |
| DE | 199 31 740 | A1 | 1/2001 |
| DE | 100 63 903 | A1 | 7/2002 |
| DE | 101 40 301 | A1 | 2/2003 |
| DE | 102 26 695 | A1 | 12/2003 |
| DE | 103 38 770 | A1 | 3/2005 |
| DE | 10 2004 045 630 | A1 | 4/2006 |
| EP | 0 987 053 | A1 | 9/1999 |
| JP | 01-096410 | A | 4/1989 |
| JP | 08-284634 | A | 10/1996 |
| KR | 200 300 16 847 | | 3/2003 |
| WO | WO 02/44530 | A1 | 6/2002 |

* cited by examiner

CENTRIFUGAL OIL MIST SEPARATION DEVICE INTEGRATED IN AN AXIAL HOLLOW SHAFT OF AN INTERNAL COMBUSTION ENGINE

CROSS REFERENCE TO RELATED APPLICATIONS

Applicants claim priority under 35 U.S.C. §119 of German Application No. 10 2005 022 254.4 filed May 10, 2005 and also German Application No. 10 2005 042 725.1 filed Sep. 8, 2005. Applicants also claim priority under 35 U.S.C. §365 of PCT/DE2006/000781 filed May 6, 2006. The international application under PCT article 21(2) was not published in English.

The invention relates to a centrifugal oil mist separator integrated into an axially hollow shaft, in particular a camshaft of an internal combustion engine.

From DE 102 26 695 A1 an axially hollow camshaft provided with an oil separator situated outside the circumference of the camshaft is known. This oil separator consists of a first annular channel having an annular gap that is open on the inside radially on one of its axial ends and an annular channel wall that is essentially closed in the radial direction and is axially opposite this annular gap. "Essentially closed" means that this wall is provided with axial passages. These axial passages communicate in a flow-conducting manner via radial openings in the circumferential wall of the camshaft with the axially hollow space of the camshaft via another second annular channel that is connected axially. With this known embodiment of a separator integrated into a camshaft, the first annular channel provided with an axial opening gap situated on the inside radially has oil drain openings provided in this outer lateral surface and extending radially outward.

This device functions as described below.

Oil mist droplets are drawn through the axial gap on the inside radially in the first annular channel due to a vacuum applied to the hollow space in the camshaft. A fluid component contained in the oil mist streams radially outward due to centrifugal force in this first annular channel, leaving this annular channel through the drain openings leading radially outward there. A certain amount of oil mist stream which usually remains passes through the axial openings in the essentially closed radial wall of the first annular channel through the second annular channel into the hollow space in the camshaft, from which this gas flow leaves the camshaft axially. With this device, no separation of oil within the axially hollow space in the camshaft is provided.

JP 08-2 84 634 A describes a hollow camshaft having an integrated oil mist separator with which the oil is separated within the hollow space of a camshaft. The oil mist stream generated by a spiral flow generating device enters into the hollow space in the camshaft at one axial end and leaves the camshaft at the opposite end. An immersion tube on this opposite end engages axially in the interior of the hollow space of the camshaft so that the gas flow remaining after separation of the liquid phase is carried away from there. The fluid component separated from the oil mist stream also leaves the camshaft at this opposite end through an annular gap between the aforementioned immersion tube and the inside wall of the hollow space in the camshaft.

U.S. Pat. No. 4,651,704 discloses a hollow camshaft in which oil is separated within the hollow space in the camshaft by centrifugal force. Radial bores are distributed over the length of the camshaft to allow the admission of oil droplets into the hollow space in the camshaft. Liquid oil thereby separated likewise leaves the hollow space in the camshaft through radial bores with a distribution of these bores over the length of the camshaft. To achieve a separation of liquid gas components of the oil mist within the hollow space in the camshaft, the hollow space in the camshaft is provided with a profiled interior lateral surface, namely such that the radial bores which carry the oil mist toward the interior radially are situated in inside wall areas having a smaller diameter than the radial bores from which the oil is removed toward the outside radially. The portion of the oil mist stream remaining after liquid separation leaves the hollow space in the camshaft at one axial end of the camshaft through a throttle opening provided there. This device lacks a centrifugal pre-separator outside of the hollow space in the camshaft on the one hand, while on the other hand, with this device, a spiral flow generating device is not provided in the hollow space in the camshaft for the oil mist stream passing through.

With a hollow camshaft known from DE 199 31 740 A1, oil is separated from an oil mist in an oil mist pre-separator in an exterior circumferential area of the camshaft. The oil mist pre-separator operates according to a principle similar to that according to DE 102 26 695 A1. The hollow space in the camshaft serves only to drain out that portion of the oil mist stream introduced into the pre-separator, said oil mist stream being freed of the liquid portion separated in the pre-separator.

The present invention relates primarily to the problem of improving the efficacy of a centrifugal oil mist separator integrated into an axially hollow shaft of an internal combustion engine in comparison with the state of the art known in the past.

This problem is solved by a device having all the features of Patent claim 1.

Advantageous and expedient embodiments are the subject matter of subordinate claims 2 through 6 and 11 through 15 inasmuch as these refer back to any of claims 1 through 6.

The invention is thus based on the general idea of creating a centrifugal oil mist separator integrated into a hollow shaft of an internal combustion engine, whereby a pre-separation in an outer area fixedly connected to the shaft is combined with a post-separation and/or final separation inside the hollow space in the shaft. The pre-separator serves to separate the liquid oil content which is present in relatively large oil droplets, while the fine oil mist droplets are separated in the area of final separation. To separate the fine oil mist droplets, a spiral flow is imparted to the oil mist stream within the hollow space in the shaft by means of a spiral flow generating device. Due to this spiral flow, these fine oil droplets can be separated especially effectively toward the outside radially, resulting in an accumulation on the inside circumferential surface of the hollow space in the shaft. For a suitably good separation within the hollow space in the camshaft, a relatively long flow path downstream from the spiral flow generating device is especially advantageous. The spiral flow generating device is therefore situated in an axial area of the hollow space in the shaft which is in relatively close proximity to the oil mist inlet area. Downstream from the spiral flow generating device, the flow length should preferably correspond approximately to ten times the value of the flow cross section in which the spiral flow generating device is situated inside the hollow space in the shaft.

A conical and/or funnel-shaped jacket which surrounds the oil mist inlet openings and is fixedly attached to the shaft is very suitable as the pre-separator, its narrow end being designed to be closed axially and being assigned and adjacent to the radial oil mist inlet openings. Oil mist to be separated may enter the interior area of this jacket through the wide axial end of the conical jacket and may flow from there through the radial oil mist inlet openings into the hollow space in the shaft. Due to the inclination of the lateral inside surface prevailing toward the open end of the conical jacket, the maximal centrifugal force acting on the jacket surface is at the open end of the jacket, decreasing continuously according to the inclination of the jacket toward the end of the jacket that is closed axially. Due to this centrifugal force gradient prevailing in the axial direction of the jacket, an axial force component is established, conveying the separated oil in the direction of the wide end of the conical jacket. This conveyance effect can be further potentiated by a corresponding design of the inside surface of the conical jacket like a conveyor screw, where the windings of the conveyor screw are to be aligned in such a way that a corresponding conveyor effect can also in fact occur with rotation of the shaft.

For the outflow of the oil mist stream, i.e., the portion that no longer contains the fluid component that has been separated, it is advantageous to provide a stationary outflow channel whose inlet cross section is approximately aligned axially in the respective end wall plane of the respective end of the camshaft. This means in particular that the outflow cross section should not lie within an immersion tube protruding into the interior of the hollow space in the shaft.

At the end of the shaft where the gas component of the oil mist stream is removed, a radial discharge channel is provided according to this invention for a gravity-induced outflow of the liquid oil separated. This oil can emerge from this discharge channel exclusively in an opened state of a closing valve provided inside this channel. This closing valve is advantageously designed as a gravity valve which is able to open automatically under the gravitational force of the collected oil. Separated oil is removed through such a gravity valve not continuously but discontinuously, namely whenever enough liquid oil has been separated and collected to open the gravity valve.

The embodiments of an inventive oil mist separator described above are especially advantageously suitable in a design of the hollow shaft as a camshaft of an internal combustion engine.

When using an inventive oil mist separator integrated into a camshaft of an internal combustion engine, in particular within an engine crankcase, the downstream end may be designed for a gas return flow, i.e., for a return flow of crankcase air that has been freed of oil droplets. Details in this regard can be derived from a description below of a corresponding exemplary embodiment.

Another problem addressed by the invention consists of designing an oil mist separator of an automotive internal combustion engine as an axial cyclone in the simplest possible form with good efficiency at the same time.

This problem is solved essentially by a design of such an axial cyclone according to Patent claim 7.

Advantageous and expedient embodiments of this aspect of the invention are the subject matter of the subordinate Claims which follow claim 7.

This aspect of the invention is based on the general idea of providing an axial cyclone completely free of integration of other function elements in or on the internal combustion engine in an area offering sufficient room for this. This area may essentially lie inside or outside the crankcase. Inside the crankcase in the aforementioned sense means inside a space that is sealed from the outside and is acted upon by crankcase gases containing oil droplets.

For all types of embodiments, regardless of whether they are used inside or outside the crankcase, the axial cyclone as an oil droplet separator consists essentially of a tubular separation casing which in the simplest case is a simple tube supported in the engine in a stationary mount with the least possible friction.

The drive of the tubular separator housing for driving the rotation thereof for separation operation may be provided by an independent drive, e.g., designed as an electric motor or by joint use of a drive provided for other function elements.

When using a separate electric motor, the tubular separator housing may be part of the electric motor in that it forms the rotor of such a motor.

It is also possible for the tubular separator housing to be driven exclusively by the oil mist stream flowing through this housing. The drive is provided by the spiral flow generating device mounted inside the tubular separator housing, converting the flow energy of the oil mist stream into rotational energy.

In use of an inventive oil mist separator, seals may be provided on the incoming and outgoing flow sides to provide a seal merely in the form of a diaphragm gland, i.e., they are not absolutely tight. This is made possible due to the fact that the oil mist stream is sucked with a vacuum through the separator housing, namely toward the air intake connection of the internal combustion engine. Such diaphragm glands allow low frictional losses due to the seal.

The pressure gradient inside the separator housing may optionally be increased by using a pump.

Oil mist separators in the form of an axial cyclone are essentially already known in many embodiments, e.g., from DE 102 26 695 A1, JP 08-284 634 A, U.S. Pat. No. 4,651,704 and DE 199 31 740 A1. These known axial cyclones are each integrated into the camshaft of an internal combustion engine. The prerequisite for this is that such camshafts are designed as hollow shafts.

In addition, it is known that such axial cyclones may be integrated into the crankcase of an internal combustion engine (DE 196 08 503 C2) or into differential shafts of an internal combustion engine (DE 197 06 383 C2).

With these integration approaches, the integration measures to be taken are in some cases quite complex. Furthermore, integration into rotary engine elements is possible only if they have already been recessed in a tubular shape or such recesses can be easily created therein.

Other known oil mist separators although they are not specifically comparable to the present invention, are known from DE 103 38 770 A1 (cyclone separator with rotating separator plates inside a co-rotational housing), U.S. Pat. No. 3,561,195 A (blade rotor with axial flow deflection by 180°), DE 199 14 166 A1 (centrifuge without rotating exterior housing), DE 100 63 903 A1 (centrifuge without rotating exterior housing), DE 35 41 204 A1 (centrifuge without rotating exterior housing), U.S. Pat. No. 4,189,310 (centrifuge without any mentionable axial flow), U.S. Pat. No. 1,979,025 (centrifuge without pronounced axial flow), EP 0 98 70 53 A1 (centrifuge without pronounced axial flow), WO 02/44 530 A1 (centrifuge without a rotating exterior housing), KR 200 300 16 847 A (centrifuge without a rotating exterior housing).

Advantageous exemplary embodiments are explained in greater detail below and illustrated schematically in the drawing.

Figure 2:
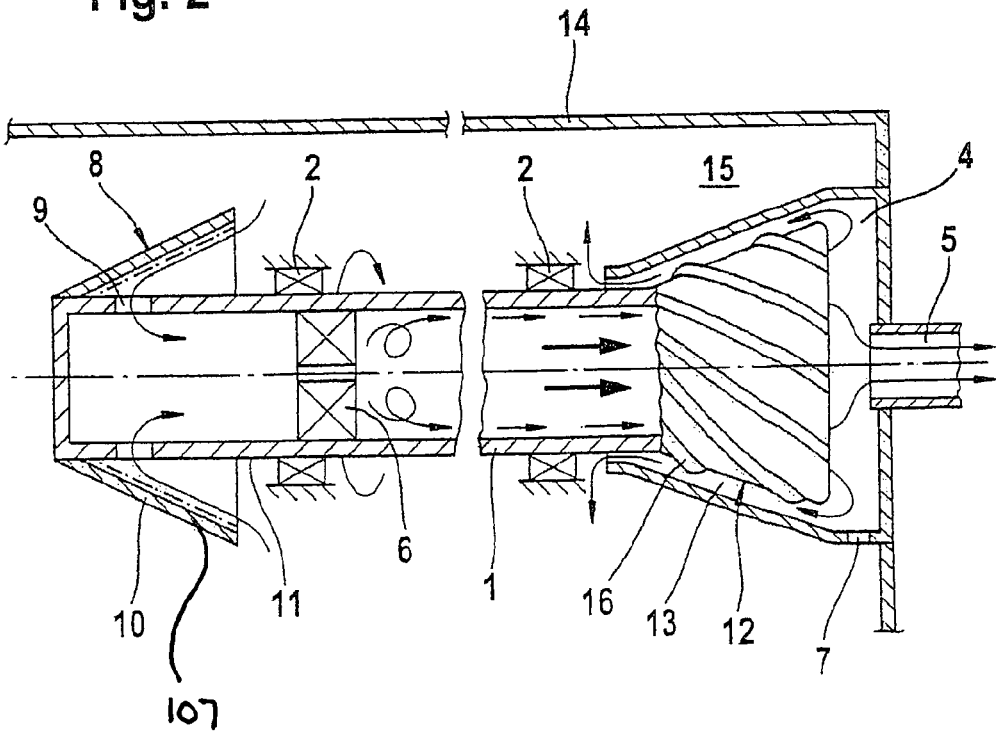
Figure 3:
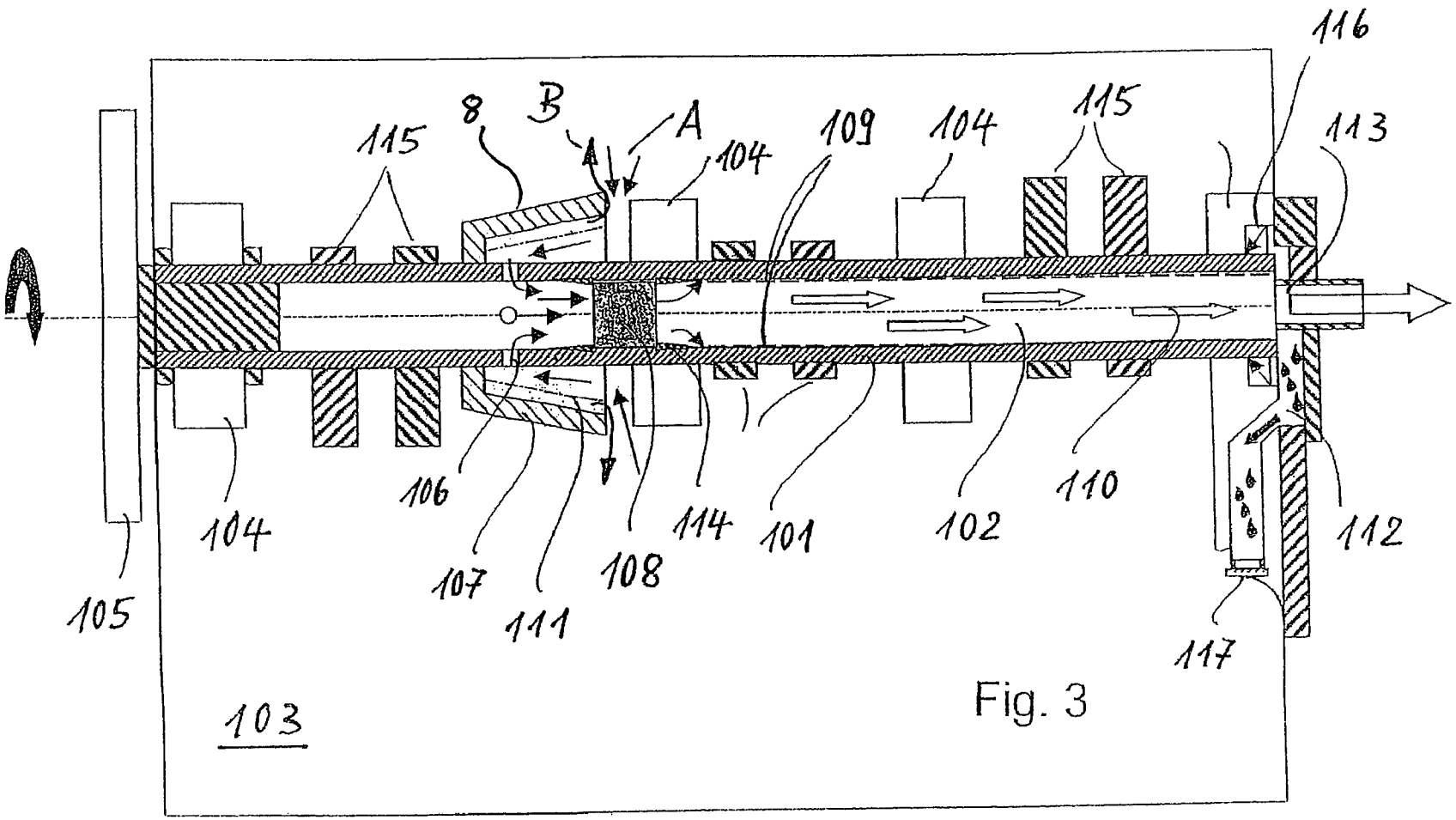

They illustrate:

FIG. 1 a longitudinal section through an axial cyclone mounted outside a crankcase, FIG. 2 a section through an axial cycle mounted inside a crankcase, FIG. 3 a longitudinal section through an oil mist separator integrated into a camshaft of an internal combustion engine.

EMBODIMENT ACCORDING TO FIG. 1

The heart of the oil mist separator designed as an axial cyclone according to this invention consists of a tubular separator housing 1 representing a shaft. It is mounted in stationary mounts on the engine via bearings 2 with the least possible friction. On the oncoming flow end, an inlet channel 3 guides an oil mist stream axially into the interior of the tubular separator housing 1. The inlet channel 3 engages peripherally with an extremely low play into the interior of the tubular separator housing 1, so that an adequate seal may be provided if a sufficient vacuum prevails in the interior thereof with respect to the atmosphere during operation of the axial cyclone.

On the output end, the tubular separator housing 1 engages with its outside circumference in a funnel-shaped receiving space 4 which is fixedly mounted on the engine. In the area where the tubular separator housing 1 engages in the receiving space 4 it is mounted on the outside wall thereof via one of the bearings 2. This bearing 2 may be designed as a bearing that at least largely provides a seal so that the interior of the receiving space 4 may already be adequately sealed with respect to the atmosphere. An outlet channel 5 leads out of the receiving space 4 in axial alignment with the tubular separator housing 1. Inside the tubular separator housing 1, there is a spiral flow generating device 6. During operation of the axial cyclone, the spiral flow generating device is in rotation and oil droplets flow through it in the direction from the inlet channel 3 to the outlet channel 5. Oil droplets that are separated settle downward through gravity in the receiving space 4 and can be discharged from the latter through a drain opening 7.

No drive element for the tubular separator container 1 by means-of which it is rotated is shown in the drawing, which is intended only to represent the device schematically. However, such a drive may act at any point in the tubular separator housing 1. A separate drive may optionally be omitted if the flow energy of the oil mist stream is sufficient to drive the tubular separator housing 1 via the spiral flow generating device 6. In such a case, an extremely low-friction bearing 2 must be ensured, which is fundamentally possible. Adequate flow energy may optionally also be created by using a pump to convey the oil mist through the axial cyclone. An axial cyclone in the embodiment according to FIG. 1 may be provided, for example, in a covering hood of an internal combustion engine. In particular, almost all parts of the inventive axial cyclone may be plastic parts that can be manufactured in an economically advantageous manner. The abutments and connections for the axial cyclone may also be economically integrated into elements of the motor which are made of plastic in particular.

Exemplary Embodiment According to FIG. 2

The axial cyclone according to FIG. 2 is accommodated inside a crankcase 14. The basic design of this axial cyclone corresponds to that according to the embodiment in FIG. 1. Elements having the same function are therefore labeled with the same reference numerals.

There are differences in the supply and removal of the oil mist and/or the components separated from one another and to be removed from the oil mist.

At the incoming flow end, a pre-separator 8 is provided. There are radial inlet openings 9 leading into the interior of the tubular separator housing 1 inside this pre-separator 8, the design of which is explained in greater detail below.

The pre-separator 8 is formed by a funnel 10 which extends coaxially around the tubular separator housing 1 in the form of a conical jacket 107 in the area of the inlet openings 9. The conical jacket 107 of the funnel 10 has a closed axial end and an open axial end, whereby the closed end is in tight contact with the conical jacket 107 and the open end is in contact with its wide opening cross section.

The spiral flow generating device 6 is provided in the hollow space of the tubular separator housing 1 with a relatively small axial distance from the inlet openings 9. As in the embodiment according to FIG. 1, , the description of which need not be repeated here, this spiral flow generating device 6 has the function of inducing a spiral flow in the oil mist stream passing through the hollow space in the tubular separator housing to thereby be able to obtain a layer of separated liquid oil on the inside wall of the tubular separator housing 1 downstream from the spiral flow generating device 6 to a particularly great extent. The oil film resulting from such separation is indicated by flow arrows near the wall in the drawing. The gaseous component of the oil mist stream which has been at least largely freed of liquid oil components is represented by flow arrows (shown in bold) downstream from the spiral flow generating device 6.

The inside lateral surface of the conical jacket of the funnel 10 is designed in the form of a screw conveyor in particular, specifically in an area outlined in the drawing with a dash-dot line 11. In flowing through the annular space inside the conical jacket of the funnel 10, the oil mist stream is set in rotation by the rotating tubular separator housing 1 to which the conical jacket is fixedly connected, before this oil mist stream enters the radial inlet openings 9 into the interior of the tubular separator housing 1. Due to the conical and/or funnel shape of the conical jacket, an axial force component in the direction of the open axial end of the conical jacket occurs in the oil separated as an oil film on the inside wall of the conical jacket due to centrifugal forces. This axial component results from the fact that the centrifugal force increases with an increase in the inside diameter of the inside surface of the conical jacket, resulting in a positive centrifugal force gradient in the direction of the open end of the conical jacket. This gradient in turn leads to an axial force component in the direction of the open end of the conical jacket, driving the oil separated on the inside circumference of the conical jacket toward the open axial end from which it can flow out. The conical jacket therefore fulfills the function of a pre-separator 8.

The main separation takes place in the hollow space in the tubular separator housing 1. The oil mist stream penetrating into the hollow space through the radial inlet openings 9 is set in spiral flow is induced in the oil mist stream by the spiral flow generating device 6 which is situated in relative proximity axially to these openings 9 in the hollow space of the tubular separator housing 1.

Flow of the oil mist through the conical jacket as a pre-separator 8 and the hollow space inside the tubular separator housing 1 is created due to a vacuum to which the hollow space in the tubular separator housing is exposed.

On the outflow end of the spiral flow generating device 6 there is separate removal of oil liquid separated on the one hand through a drain opening 7 and of the gas component on the other hand, which is removed through an outlet channel 5. The outlet channel 5 is arranged so that it is aligned axially with respect to the axis of the tubular separator housing 1. It has an axial distance from the tubular separator housing 1 because a receiving room 4 is provided between the tubular separator housing and the end of the tubular separator housing 1. From the end of the tubular separator housing outward, a funnel area 12, which is fixedly connected to the former, protrudes from the end of the tubular separator housing 1 into the receiving area 4. Between the outside circumference of this funnel area 12 and an outside wall of the receiving area 4 that is approximately complementary to the former, there exists a flow annular channel 13. This flow annular channel 13 opens to the outside in the area of the narrow end of the funnel area 12 into the crankcase interior space 15, which is enclosed by the crankcase wall 14. To induce and/or promote a return flow of gas components from the oil mist stream which has been freed of oil components, corresponding baffle means 16 are provided on the outside circumference of the funnel area 12.

As in the embodiment according to FIG. 1, any drive means required for the tubular separator housing 1 are not shown in the drawing. As in the embodiment according to FIG. 1, the rotational energy for the tubular separator housing 1 may be applied in a sufficient form by the oil mist stream itself and may be implemented in the spiral flow generating device.

Exemplary Embodiment According to FIG. 3

An axially hollow camshaft 101 with a hollow space 102 is rotatably mounted in a camshaft housing 103. The bearings for the camshaft are indicated by 104. The camshaft 101 is driven via a chain wheel 105 which is outside the camshaft housing 103.

An oil mist stream from which oil is to be separated as a liquid phase is indicated with arrows A. According to these arrows A, the oil mist stream to be separated passes through oil mist feed openings 106 provided in the wall of the camshaft 101 into the hollow space 102 in the camshaft 101. In the area of the oil mist feed openings 106, a pre-separator 8 formed by a funnel in the form of a conical jacket 107 extends around these oil mist feed openings 106 with the axis of the camshaft 101 aligned coaxially. The conical jacket 107 has a closed axial end and an open axial end, whereby the closed end is situated at its narrow opening cross section an the open end is situated at its wide opening cross section. coaxially. The conical jacket 107 has a closed axial end and an open axial end, whereby the closed end is situated at its narrow opening cross section an the open end is situated at its wide opening cross section.

A spiral flow generating device 108 is provided in the hollow space 102 of the camshaft 101 with a relatively small axial distance from the oil mist inlet openings 106. This spiral flow generating device 108 has the function of inducing a spiral flow in the oil mist stream passing through the hollow space 102 of the camshaft 101 to thereby be able to achieve a layering of separated liquid oil on the inside wall of the camshaft 101 to a particularly great extent downstream from the spiral flow generating device 108. The oil film resulting from such a separation is indicated with dashed lines 109 in the drawing. The gaseous portion of the oil mist stream which has been at least mostly freed of liquid oil content is indicated with arrows 10 downstream from the spiral flow generating device 108.

The inside lateral surface of the conical jacket 107 is designed in the form of a screw conveyor, especially in an area that is outlined with a dash-dot line 111 in the drawing. In flow through the annular space inside the conical jacket 107, rotation of the oil mist stream is induced by the rotating camshaft 101 to which the conical jacket 107 is fixedly connected before this oil mist stream enters the radial oil inlet openings 106 in the camshaft 101. Due to the conical and/or funnel shape of the conical jacket 107, the result is an axial force component in the direction of the open axial end of the conical jacket 107 in the oil separated as an oil film on the inside wall of the conical jacket 107 due to centrifugal forces. This axial component results from the fact that the centrifugal force increases with an increase in the inside diameter of the inside surface of the conical jacket 107, resulting in a positive centrifugal force gradient in the direction of the open end of the conical jacket. This gradient in turn leads to an axial force component in the direction of the open end of the conical jacket 107 which drives oil separated on the inside circumference of the conical jacket to the open axial end from which it can flow out radially according to the arrows B. The conical jacket 107 thus fulfills the function of a pre-separator.

Another "final" separation and/or "post-separation" takes place in the hollow space 102 of the camshaft 101. The oil mist stream penetrating into the hollow space 102 through the radial oil mist inlet openings 106 is set in spiral motion by the spiral flow generating device 108 which is situated axially in relative proximity to these openings in the hollow space 102 of the camshaft 101. In this way, liquid oil components within the oil mist stream may be separated especially effectively as an oil film 109 on the inside wall of the hollow space 102 of the camshaft 101.

Flow of the oil mist through the conical jacket as a pre-separator and the hollow space 102 of the camshaft 101 is created by a vacuum to which the hollow space 102 of the camshaft 101 is exposed.

On the end of the camshaft 101 situated on the outflow end in relation to the spiral flow generating device 108, there is a separate removal of liquid oil separated through an oil discharge channel 112 and also separate removal of the gas component which is removed through a gas discharge channel 113. The gas discharge channel 113 is arranged so it is aligned axially with respect to the axis of the camshaft 101, namely so that it abuts on the respective end face of the camshaft 101. The gas discharge channel 113 does not protrude into the hollow space 102 of the camshaft 101 in the manner of an immersion tube. The opening cross section of the gas discharge channel 113 may be identical to that of the hollow space 102 of the camshaft 101.

The oil discharge channel 112 is designed as an annular channel adjacent to the respective end of the camshaft 101, surrounding the gas discharge channel 113 through which annular channel liquid oil that is separated can flow out. The ring-shaped area of the oil discharge channel 112 develops into an approximately tubular channel section into which liquid oil that has separated can flow out under the influence of gravity. The liquid oil thus separated can flow out of this area into the crankcase of an internal combustion engine containing the camshaft 101. Since there is a pressure gradient between the hollow space 102 in the camshaft 101 on the one hand and the crankcase on the other hand, said pressure gradient acting in the direction of the hollow space 102 of the camshaft 101, therefore a so-called gravity valve 117 may be provided in the oil discharge channel 112. A gravity valve is understood here to refer to a closing valve 117 which is opened by the weight of the liquid oil collecting upstream from the valve. This avoids an equalization of pressure between the hollow space 102 in the camshaft 101 on the one hand and the crankcase of the internal combustion engine on the other hand. This has the advantage that separated droplets of oil need not overcome an outflow resistance due to such an equalization of pressure on leaving the hollow space 102 of the camshaft 101, which would at least tend to have a harmful effect on the separation.

The spiral flow generating device 108 can simply be inserted into the hollow space 102 of the camshaft 101 for the installation. The spiral flow generating device 108 can be secured by means of, for example, by bilateral caulking with material from the inside wall of the camshaft 101. To do so, a caulking tool need only be inserted axially into the hollow space, namely on both ends of the camshaft 101 if the spiral flow generating device 108 is to be caulked axially on both ends. The caulked areas are labeled as 114 in the drawing.

Between the bearings 104 of the camshaft 101, cams 115 are provided, distributed over the length of the shaft.

The gas discharge channel 113 is fixedly connected to the camshaft housing 103. The interior of the camshaft housing 103 is sealed by a ring seal 116 in the area of the oil discharge channel 103 with respect to this discharge channel within a neighboring bearing 104.

All the features characterized in the description and in the following claims may be essential to the present invention either individually or combined together in any form.

The invention claimed is:

1. A centrifugal oil mist separator device integrated into an axially hollow shaft (1, 101), wherein the shaft (1, 101) is provided with radial oil mist inlet openings (9, 106) for oil mist to be fed into the axially hollow space of the shaft (1, 101) at the first end, and on the second end for draining with a radial oil discharge channel (13, 112) for oil separated as a liquid phase on the one hand and an axial gas discharge channel (5, 113) for the oil mist stream remaining after the liquid component has been separated on the other hand, a centrifugal oil mist pre-separator is connected upstream from the radial oil mist inlet openings (9, 106) as a pre-separator (8) connected fixedly to the shaft (1, 101), and a spiral flow generating device (6, 108) is provided as the final separator within the axially hollow space of the shaft (1, 101).

2. The device according to claim 1, wherein the pre-separator (8) is designed as a conical jacket surrounding the shaft (1, 101) coaxially and enclosing the radial oil mist inlet openings (9, 106) whereby its narrow end is closed axially and is assigned and adjacent to the radial oil mist inlet openings (9, 106).

3. The device according to claim 1, wherein the inside surface of the conical jacket (107) of the pre-separator (8) is designed in the form of a conveyor screw with a direction of conveyance toward the wide end of the conical jacket (107).

4. The device according to claim 1, wherein the spiral flow generating device (6, 108) represents a fixed component secured by deformation of the shaft material occurring after insertion, said fixed component being inserted into the axially hollow space of the shaft (1, 101) and secured there by deformation of the shaft material after insertion.

5. The device according to claim 1, wherein the axial gas discharge channel (5, 113) provided on the second end of the shaft (1, 101) is designed to be axially aligned downstream from its respective end face of the rotatably mounted shaft (1, 101) in a stationary position.

6. The device according to claim 1, wherein the radial oil discharge channel (13, 112) provided on the second end of the shaft (1, 101) is equipped with a closing valve (117) which opens only under the gravitational force of the oil collected there.

7. A centrifugal oil mist separator of an automotive internal combustion engine, the separator being integrated into an axial hollow shaft (1, 101) in the form of an axial cyclone, having a tubular separator housing (1, 101) capable of rotating about the tube axis and rotating about said axis in separation operation and having a spiral flow generator (6, 108) provided in said separator housing (1, 101) according to claim 1, wherein the separator housing (1, 101) has exclusively the function of the oil mist separator.

8. The centrifugal oil mist separator of an automotive internal combustion engine, said separator being integrated into an axial hollow shaft (1, 101) in the form of an axial cyclone, having a tubular separator housing (1, 101) capable of rotating about the tube axis and rotating about said axis in separator operation and having a spiral flow generator (6, 108) provided therein, according to claim 1, inasmuch as it is not integrated into a camshaft of an internal combustion engine, wherein the separator housing (1, 101) can be set in rotation, which is effective in separation, by flow energy emanating exclusively from the oil mist flow and acting on the spiral flow generator (6, 108) as a driving force.

9. The oil mist separator according to claim 8, wherein the separator housing (1, 101) is connected to an electric motor drive.

10. The oil mist separator according to claim 9, wherein the separator housing (1, 101) is designed as the rotor of the electric motor drive.

11. The oil mist separator according to claim 1, having a downstream axial end, characterized by the following features:

the rotatably mounted tubular separator housing (1) opens into a radially enlarging receiving space (4) of the stationary receiving housing, an outlet channel (5) at a distance axially from the respective axial end of the tubular separator housing (1) leads in axial alignment with the tube axis of the separator housing (1) from the receiving space (4) to divert the gas component of the previously treated oil mist while a drain opening (7) for oil to be removed is provided in an area of the receiving space (4) situated geodetically below the former.

12. The oil mist separator according to claim 1, wherein the receiving space (4) is designed in a funnel shape with a diameter that increases downstream.

13. The oil mist separator according to claim 12, wherein the downstream end of the tubular separator housing (1) tapers to a conical funnel area (12) extending into the receiving space (4), whereby an annular flow channel (13) having an approximately equal thickness throughout is provided between the outside circumference of the funnel-shaped area (12) and a complementary outside wall of the receiving space (4) with an open outlet on the adjacent end to the tubular separator housing (1).

14. The oil mist separator according to claim 13, wherein baffles (16) are provided on the outside of the funnel area (12) for generating a flow developing toward the end of the flow annular channel (13) that is open toward the outside.

15. The oil mist separator according to claim 1, wherein the oil mist is added to and/or removed from the tubular separator housing (1) through transitions between a stationary inlet channel (3) on the one hand and a stationary outlet channel (5) on the other hand with respect to the tubular separator housing (1) which have seals that operate without friction in the form of a sealing gap.

16. The device according to claim 1, wherein the axially hollow shaft is a camshaft of an internal combustion engine.

* * * * *